United States Patent [19]

Pernet

[11] Patent Number: 4,478,178

[45] Date of Patent: Oct. 23, 1984

[54] PRESSURIZATION DEVICE FOR THE COOLING SYSTEM OF A HEAT ENGINE

[75] Inventor: Jean-Paul Pernet, Chassieu, France

[73] Assignee: Renault Vehicules Industriels, Boulogne-Billancourt, France

[21] Appl. No.: 493,814

[22] Filed: May 12, 1983

[30] Foreign Application Priority Data

Jul. 8, 1982 [FR] France ..... 82 11977

[51] Int. Cl.[3] ..... F01P 11/02; B65D 51/16

[52] U.S. Cl. ..... 123/41.01; 123/41.54; 220/203; 220/303

[58] Field of Search ..... 123/41.08, 41,15, 41.54, 123/41.01; 220/203, 209, 303, 360, 361, 366, 367, DIG. 27, DIG. 32

[56] References Cited

U.S. PATENT DOCUMENTS

| | | | |
|---|---|---|---|
| Re. 27,965 | 4/1974 | Avrea | 165/11 |
| 3,062,400 | 11/1962 | Humbert | 220/203 |
| 3,071,285 | 1/1963 | Friend | 220/203 |
| 3,162,182 | 12/1964 | Gratzmuller | 123/41.54 |
| 3,171,392 | 3/1965 | Alfieri | 123/41.01 |
| 3,910,451 | 10/1975 | Tusing | 220/203 |
| 4,023,583 | 5/1977 | Parkinson | 220/203 |
| 4,241,845 | 12/1980 | Daly et al. | 220/203 |

FOREIGN PATENT DOCUMENTS 1252170 4/1961 France .

*Primary Examiner*—William A. Cuchlinski, Jr.
*Attorney, Agent, or Firm*—Oblon, Fisher, Spivak, McClelland & Maier

[57] ABSTRACT

This invention has as its object a pressurization device for a cooling system of a heat engine. According to the invention, the device (10) includes two pressure relief valves (20, 30) mounted in a series, a chamber (32) between the pressure relief valves (20, 30), and a source (34) of gas under pressure connected to the chamber (32). The expansion chamber (12) is not subjected to the scavenging of the pressurization gas, and the maximum value of the pressurization is equal to the sum of the values of the calibrations of the two pressure relief valves (20, 30).

4 Claims, 4 Drawing Figures

PRESSURIZATION DEVICE FOR THE COOLING SYSTEM OF A HEAT ENGINE

BACKGROUND OF THE INVENTION

1. Field of the Invention

This invention relates to a pressurization device for the cooling system of a heat engine such as, for example, an internal combustion engine.

2. Background of the Invention

Pressurization devices for the cooling systems of heat engines are known that comprise an enclosure, fed by a source of gas under pressure and in which the cooling liquid of the heat engine circulates. The enclosure can be, for example, an expansion chamber. These devices are provided with a pressure relief valve connected to the atmosphere and having a first calibration value. The pressure relief valve is provided to reduce the pressure that prevails in the system when the pressure exceeds the first calibration value.

These days, the majority of road vehicles provided with an internal combustion engine operate with a pressurized cooling system hvaing a plug that incorporates a valve of the type which has just been described calibrated at a pressure greater than the atmospheric pressure. The valve makes it possible to raise the boiling temperature of the cooling liquid and, therefore, to increase the cooling system's capacity for dissipation of the heat of the cooling liquid. These devices have a great capacity for dissipating the heat, but have the drawback that there is a constant scavenging of the cooling liquid at the upper part of the expansion chamber by the pressurization gas. This scavenging results in losses of cooling liquids.

OBJECTS OF THE INVENTION

A principal object of the invention is to provide a pressurization device that makes it possible to fix the desired pressure in the cooling circuit, no matter what the engine load, but without there being a scavenging of the expansion chamber by the pressurization gas.

SUMMARY OF THE INVENTION

With this aim in view, the invention proposes a pressurization device of the type mentioned above, characterized in that it has a second pressure relief valve that has a second calibration value. The second pressure relief valve is mounted in series with the first pressure relief valve between the latter and the enclosure so as to define between the first and second valves a chamber connected to the source of gas under pressure. A depression valve is provided to connect the chamber with the enclosure when the pressure prevailing in the enclosure is lower than the pressure prevailing in the chamber.

Because of these characteristics, the device according to this invention makes it possible to prevent the scavenging of the enclosure by the pressurization gas under pressure. At the same time, the device according to this invention assures that the enclosure has a pressurization level equal to the atmospheric pressure increased by the sum of the first and second calibration values.

Moreover, as will be described in greater detail, the device makes it possible to continue to provide a pressurization of the circuit in case of failure of one of the two valves.

DETAILED DESCRIPTION OF THE PRESENTLY PREFERRED EMBODIMENT

Figure 1:
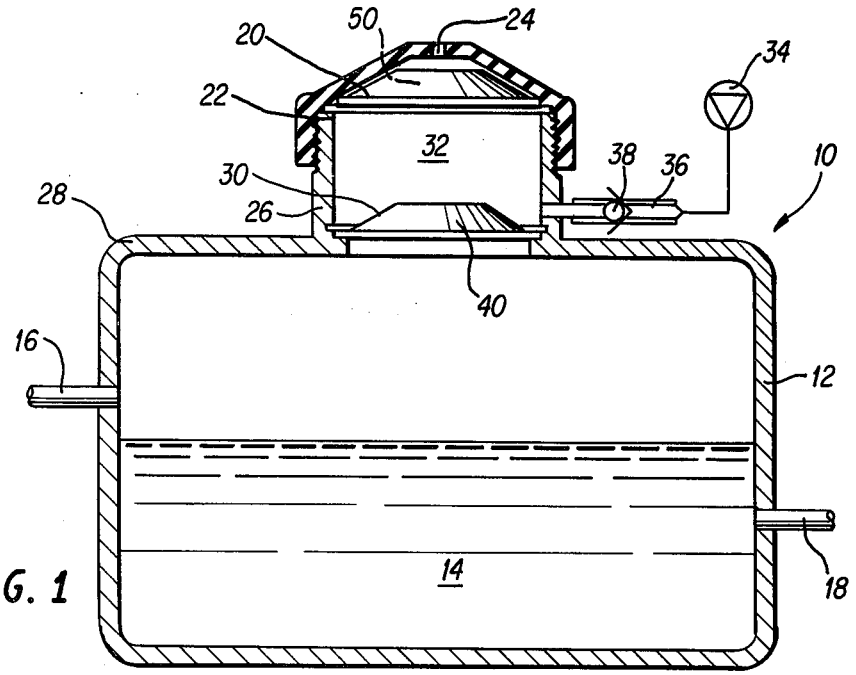
FIG. 1 is a general view of the presently preferred embodiment of the pressurization device made according to the teachings of this invention.

Represented in FIG. 1 is a portion of a cooling system of a heat engine such as, for example, an internal combustion engine. The cooling system has a pressurization device 10 made according to the teachings of this invention.

Pressurization device 10 comprises an enclosure 12, such as, for example, an expansion chamber, in which cooling liquid 14 circulates. The cooling liquid 14 can enter and exit from the enclosure 12 through pipes 16 and 18.

Device 10 comprises a first pressure relief valve 20 having a first calibration value $T_1$. First pressure relief valve 20 is mounted at the upper part of enclosure 12 on which it is attached by an air tight plug 22 provided on its upper face with an opening 24 that leads to the atmosphere. More precisely, first pressure relief valve 22 is mounted at the end of a tubular throat 26 joined on upper face 28 of enclosure 12.

The pressurization device has a second pressure relief valve 30 that has a second calibration value $T_2$. The second pressure relief valve 30 is mounted in series with first pressure relief valve 20. Second pressure relief valve 30 is attached at the lower part of throat 26 in the vicinity of upper face 28 of enclosure 12. As can be seen in FIG. 1, second valve 30 is, therfore, mounted between first valve 20 and enclosure 12 so as to define a chamber 32 inside tubular throat 26 between first valve 20 and second valve 30.

Figure 2:
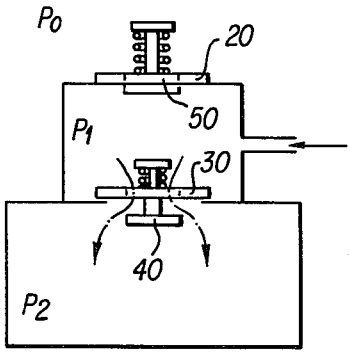
FIGS. 2-4 are diagrammatic representations of the presently preferred embodiment of this invention, illustrating various stages of operation of the device.
Figure 3:
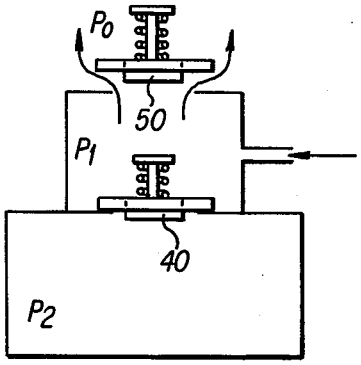
Figure 4:
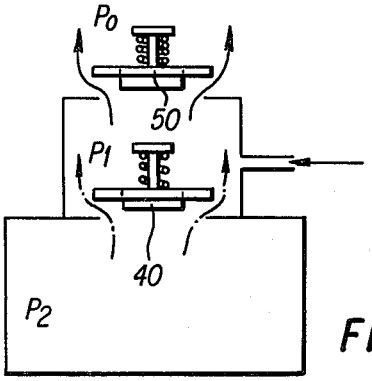

Enclosure 12 is fed by a source 34 of gas under pressure. The feeding of enclosure 12 by pressure source 34 is done through chamber 32 to which pressure source 34 is connected by a pipe 36 in which is located a check valve 38 which allows the gas under pressure to pass only from source 34 to chamber 32. To make it possible to connect enclosure 12 with pressure source 34, the device has a depression valve 40 integrated into the pressure relief valve 30. The depression valve 40 has a third calibration value $T_3$. Depression valve 40, which is represented diagrammatically in FIGS. 2-4, is provided to make it possible to connect chamber 32 with enclosure 12 when the pressure prevailing in the enclosure 12 is lower than the pressure prevailing in chamber 32.

The pressure relief valves 20 and 30 and the depression valve 40 have not been represented in detail, but are of a standard type currently used in pressurized cooling systems whose plugs are provided with calibrated depression and pressure relief valves. They may, for example, be of the type illustrated in French Pat. No. 2,439,144.

The operating mode of the pressurization device illustrated in FIG. 1 will now be described by referring particularly to FIGS. 2-4. In the embodiment shown, calibration values $T_1$ and $T_2$ of pressure relief valves 20 and 30 are equal to 250 millibars (mb). The calibration value $T_3$ of the depression valve 40 is equal to 50 mb. It will be assumed for the description which follows that the value of the atmospheric pressure $P_0$ that prevails outside the cooling circuit is equal to 1000 mb, or nearly one atmosphere. In the example shown, enclosure 12 is the expansion chamber of a cooling system for an internal combustion engine of an auto vehicle, and the source 34 of gas under pressure can, for example, be a pipe connected to the intake of the engine if the engine is of the supercharged type or be a pipe connected to the exhaust of the engine in the case of an atmospheric engine.

When the engine is started, the pressurization gas flows through pipe 36 and causes an increase in the pressure $P_1$ that prevails in chamber 32. Due to the increase in the pressure that prevails in chamber 32, depression valve 40 is opened, causing an increase in the pressure $P_2$ that prevails in enclosure 12. If the value of the pressure of the pressurization gas coming from source 34 is greater than a predetermined value equal to atmospheric pressure $P_0$ increased by calibration value $T_1$ of valve 30, the pressure $P_1$ that prevails in chamber 32 is permanently fixed at a value at least equal to that predetermined value. If, as is desirable, the value of the pressure of the pressurization gas is greater than the predetermined value increased by the second calibration value $T_2$ of the pressure relief valve 30, the pressure $P_2$ that prevails in enclosure 12 is fixed at a maximum pressurization value equal to $P_0+T_1+T_2$, or in the example illustrated 1500 mb. It is thus understood that the maximum value of the excess pressure that prevails in the circuit is equal to the sum of calibration values $T_1$ and $T_2$, no matter what the values of $T_1$ and $T_2$ are. (It should be noted that the values of $T_1$ and $T_2$ are not necessarily equal.)

When the value of pressure $P_2$ is equal to the maximum pressurization value, the pressure relief valve 30 and the depression valve 40 are in their closed positions as is represented in FIG. 3. Under these conditions, gas from pressure source 34 which continues to flow into chamber 32 at a pressure value greater than $P_0+T_1$ causes the opening of pressure relief valve 20 and the escape of the excess pressure gas to the atmosphere.

If the pressure $P_2$ that prevails in enclosure 12 and likewise in the cooling system continues to increase beyond the maximum pressurization value $P_0=T_1+T_2$, for example under the action of the expansion or vaporization of the cooling liquid, the conditions illustrated in FIG. 4 obtain. Under these conditions, the increase in the value of pressure $P_2$ causes the opening of pressure relief valve 30 until the pressure $P_2$ is again fixed at the maximum excess pressure value $P_0+T_1+T_2$.

As can be noted in FIGS. 2–4, the subject device preferably also includes a second depression valve 50 integrated with the first pressure relief valve 20. This second depression valve 50 is not always necessary to the operation of the device according to this invention, but it makes it possible to equalize the levels of pressure $P_0$ and $P_1$ when the engine is stopped and when the source 34 of gas under pressure no longer is providing gas under pressure. The calibration $T_4$ of the second depression valve 50 has to be selected, of course, at a low value—for example, equal to the value of calibration $T_3$ of the first depression valve 40.

In case pressure relief valve 20 is accidentally stuck in an open position, the pressure $P_1$ prevailing in chamber 32 will be equal to the atmospheric pressure $P_0$, and the pressurization device would still function. This would be true because the second pressure relief valve 30 would still be in service, but the maximum pressurization value would be equal to $P_0+P_2$—or, in the example shown, 1250 mb.

If, on the other hand, the second pressure relief valve 30 became stuck in the open position, the pressurization device would still continue to operate with a maximum pressurization value equal to $P_0+T_1$, but with the drawback that the device would operate with a scavenging of the enclosure by the pressurization gas.

In the example which has just been described, the maximum value of pressurization is equal to $T_1+T_2$, but it is not imperative that both calibration values be equal. However, in case one of the two valves breaks down, as has just been described, the pressure in the system will be fixed at the atmospheric value increased by the calibration value of the valve which continues to operate.

With regard to the value of the pressure of the pressurization gas coming from pressure source 34, and as has been stated earlier, it is necessary that this pressure be greater than the maximum pressurization value that is desired to be obtained in the system. However, in the case where this value is less than this maximum value, but greater than the value $P_0+T_1$, the maximum pressurization value would be maintained, but the rise in pressure of the system up to this maximum value could be done beyond the value of the feed pressure only by expansion or vaporization of the cooling liquid. In the case where the value of pressure coming from source 34 is less than the value $P_0+T_1$ (such as, in the example illustrated, 1150 mb), the maximum pressurization pressure could in no case be greater than this value increased by 250 mb, or 1400 mb.

In the embodiment illutrated in the figures, it is desired that the supply of gas under pressure be done through a calibrated opening 36, 38, because this supply must only supply an internal loss. This calibrating is desired in particular if the pressurization gas in question is taken from the engine exhaust, thereby limiting the condensation in the cooling system. Although without impact on the invention, this calibrating is also desirable if the gas is taken directly from the compressed air circuit of the vehicle or from the superfed air of the engine, so as to limit losses.

Moreover, it is desirable that the volume of chamber 32 be low in relation to the volume of enclosure 12 in order to prevent a too rapid pressure drop when valve 30 is open.

CAVEAT

While the subject invention has been described with reference to the presently preferred embodiment thereof, various changes therein will readily occur to those of ordinary skill in the art. Accordingly, the invention must be measured by the claims appended hereto and not solely by reference to the foregoing specification.

What is claimed as new and desired to be secured by Letters Patent of the United States is:

1. A pressurization device for the cooling system of a heat engine, said cooling system comprising an enclosure fed by a source of gas under pressure in which cooling liquid circulates, said pressurization device comprising:

(a) a chamber connected to the source of gas under pressure;

(b) a first pressure relief valve disposed between said chamber and the atmosphere, said first pressure relief valve having a first calibration value ($T_1$) and being oriented so as to vent the pressure in said chamber to atmosphere when it exceeds a predetermined value ($P_0+T_1$);

(c) a second pressure relief valve disposed between said chamber and the enclosure, said second pressure relief valve having a second calibration value ($T_2$) and being oriented so as to vent the pressure in said enclosure to said chamber when it exceeds the pressure in said chamber; and (d) a first depression valve disposed between said chamber and the enclosure, said first depression valve having a third calibraton value ($T_3$) and being oriented so as to vent the pressure in said chamber to the enclosure when it exceeds the pressure in the enclosure.

2. A pressurization device as recited in claim 1 wherein said chamber is connected to the source of gas under pressure by a pipe in which a check valve is placed.

3. A pressurization device as recited in claim 1 wherein the volume of said chamber is low relative to the volume of the enclosure.

4. A pressurization device as recited in claim 1 and further comprising a second depression valve disposed between said chamber and the atmosphere, said second depression valve having a fourth calibration value ($T_4$) and being oriented so as to introduce atmospheric pressure into said chamber when it exceeds the pressure in said chamber.

* * * * *